US005961302A

United States Patent [19]

Blumenau

[11] Patent Number: 5,961,302

[45] Date of Patent: Oct. 5, 1999

[54] LIQUID-SEALED VANE OSCILLATOR

[75] Inventor: Leif Blumenau, Pardes Hanna, Israel

[73] Assignee: Isocomp Ltd., D.N. Hifer, Israel

[21] Appl. No.: 09/064,130

[22] Filed: Apr. 22, 1998

[51] Int. Cl.[6] ..... F04B 23/10

[52] U.S. Cl. ..... 417/481; 417/204; 417/313; 418/267; 310/11

[58] Field of Search ..... 310/11, 22, 23, 310/24, 32, 34, 35; 62/6; 417/417, 418, 419, 204, 206, 366, 367, 415, 416, 313, 481; 418/259, 267, 268

[56] References Cited

U.S. PATENT DOCUMENTS 5,115,157 5/1992 Blumenau ..... 310/11

*Primary Examiner*—Nestor Ramirez
*Assistant Examiner*—Judson H. Jones
*Attorney, Agent, or Firm*—Mark M. Friedman

[57] ABSTRACT

A liquid-sealed vane oscillator includes a housing defining a cavity corresponding to part of a virtual annulus centered around, and extending at least 180° about, an axis of rotation and delimited by first and second ends. A vane is mounted rotatably within the cavity. The vane includes a first seal and a second seal carried with the vane and deployed so as to subdivide the cavity into a first chamber of variable volume between the first end and the first seal, a second chamber of variable volume between the second end and the second seal, and an intermediate volume between the first seal and the second seal. At least one port is provided in fluid communication with each of the first and second chambers. The oscillator also has an axial shaft, penetrating and extending from the cavity, which is mechanically coupled to the vane so as to allow exchange of mechanical power with an external device. A liquid circulation system supplies a liquid to the intermediate volume at a pressure such that the liquid flows past the first and second seals into the first and second chambers.

21 Claims, 10 Drawing Sheets

59
10
59
12
II
36
66
61
II
16
65
64
64
34
62

LIQUID-SEALED VANE OSCILLATOR

FIELD AND BACKGROUND OF THE INVENTION

The present invention relates to vane oscillators and, in particular, it concerns a liquid-sealed vane oscillator and systems of such oscillators.

Attempt shave been made to develop a liquid-sealed vane oscillator in which a liquid film provides a seal around a vane element oscillating within a cavity. Reference is made to U.S. Pat. No. 5,115,157 to the present inventor which describes such a device.

The device described in the aforementioned patent employs a vane oscillating in an annular cavity around a central axis. The cavity is divided into two chambers so that oscillations of the vane generate alternating out-of-phase variations of pressure within the chambers. Narrow gaps between the vane and the walls of the cavity are sealed by a sealing liquid which provides a dynamic seal. The sealing liquid is also intended to serve as a heat-exchange liquid in direct contact with the gas within the chambers to make the device capable of near-isothermal operation.

The device described has been found unsuitable for relatively high pressure differential applications. Specifically, when pressure in one chamber increases, the resulting pressure differential tends to force the sealing liquid between the vane and the cavity wall into the second working chamber, thereby reducing the effectiveness of the seal. As a further consequence, the quantities of liquid normally present in the chambers during operation are very high, making the design ineffective due to mechanical losses from the liquid impacting against the vane and from two-phase flow friction through the discharge valves.

An additional shortcoming of the device of the aforementioned patent relates to the drive mechanism. The patent suggests the use of a 4-bar linkage of the Grashof chain type for "effecting a controlled amplitude harmonic vane motion". In practice, however, this type of transmission is limited to use with one vane oscillator or cylinder and becomes cumbersome when applied to two or more cylinders. It is also difficult to balance inertial forces in the 4-bar linkage to achieve reduced vibration even with a single cylinder.

In a further example of a prior art liquid-sealed compressor, a Swiss company "Burckhardt" of Basel, Switzerland, at one time offered for sale a reciprocating oxygen compressor equipped with automatic force-feed lubrication acting on the principle of an automobile carburetor. The lubricating water was drawn into the inlet flow of oxygen by the suction effect of a venturi section of pipe. The water was then removed from the outlet flow by a separator and fed back to the supply system by the pressure difference between the compressor inlet and outlet. The water introduced into the compressor not only acted as a sealing liquid and lubricant, but also provided some degree of internal, evaporative cooling.

The evaporative cooling in the Burckhardt design only provided partial removal of the heat of compression and was incapable of providing heat exchange for expansion. True isothermal compression by the method of Direct Contact Heat Exchange (DCHX) where significant heat is transferred to the cooling liquid from the gas would require much more liquid throughput than is possible with the Burckhardt carburetor.

There is therefore a need for a liquid-sealed vane oscillator which is capable of operating with high pressure differentials, and in which the sealing liquid is effective as a heat-exchange medium for producing near-isothermal operation. It would also be advantageous to provide a liquid-sealed vane oscillator system in which a number of oscillators are engaged synchronously with low levels of vibration.

SUMMARY OF THE INVENTION

The present invention is a liquid-sealed vane oscillator.

According to the teachings of the present invention there is provided, a liquid-sealed vane oscillator comprising: (a) a housing having a virtual axis, the housing defining a cavity formed to correspond to part of a virtual annulus centered around, and extending at least 180° about, the axis, the cavity being delimited by a first end and a second end; (b) a vane mounted within the cavity so as to be rotatable about the axis, the vane including a first seal and a second seal carried with the vane and deployed so as to subdivide the cavity into a first chamber of variable volume between the first end and the first seal, a second chamber of variable volume between the second end and the second seal, and an intermediate volume between the first seal and the second seal, such that oscillatory rotation of the vane about the axis corresponds to oscillatory out-of-phase variations of volume of the first and second chambers; (c) at least one port in fluid communication with each of the first and second chambers; (d) a mechanical transmission including an axial shaft penetrating and extending from the cavity, the axial shaft being mechanically coupled to the vane so as to allow exchange of mechanical power with an external device; and (e) a liquid circulation system in fluid communication with both the intermediate volume and the at least one port of each of the first and second chambers, the liquid circulation system being configured to supply a liquid to the intermediate volume at a pressure such that the liquid flows past the first and second seals into the first and second chambers.

According to a further feature of the present invention, the at least one port in fluid communication with each of the first and second chambers features a suction valve and a discharge valve for each of the first and second chambers.

According to a further feature of the present invention, the liquid circulation system includes: (a) a separator associated with the discharge valve of at least the first chamber so as to collect amounts of the liquid from a gas-liquid mixture discharged from the first chamber; and (b) a pump connected serially between a liquid outlet of the separator and the intermediate volume for injecting the collected liquid into the intermediate volume.

According to a further feature of the present invention, the liquid circulation system further includes a heat exchanger connected in series with the pump between the liquid outlet of the separator and the intermediate volume for supplying heat of expansion.

According to a further feature of the present invention, the mechanical transmission is driven by an external power source such that the vane oscillator functions as a compressor, the liquid circulation system including a separator associated with the discharge valve of at least the first chamber so as to collect amounts of the liquid from a gas-liquid mixture discharged from the first chamber, the separator being connected so as to supply the collected liquid to the intermediate volume at a pressure substantially equal to a discharge pressure of the first chamber.

According to a further feature of the present invention, the liquid circulation system further includes a heat exchanger connected serially between a liquid outlet of the separator and the intermediate volume for removing heat of compression.

According to a further feature of the present invention, at least a part of the mechanical transmission adjacent to penetration of the shaft into the cavity is located within a casing having an enclosed casing volume, the vane oscillator further comprising a pressure equalization line providing fluid connection between a gas outlet of the separator so as to maintain the casing volume at a pressure substantially equal to a maximum operating pressure of the first chamber.

According to a further feature of the present invention, at least a part of the mechanical transmission is located within a casing having an enclosed casing volume, the vane oscillator further comprising a source of pressurized fluid connected to the casing volume so as to maintain the casing volume at an elevated pressure.

According to a further feature of the present invention, the mechanical transmission further includes: (a) a rocker arm fixed to the shaft and having an end extending from the shaft in a direction perpendicular to the virtual axis, the end featuring a cam follower; (b) a flywheel rotatably mounted about a flywheel axis parallel to, but displaced from, the virtual axis, the flywheel providing a form-closed guide track encompassing but not symmetrical about the flywheel axis, the cam follower being engaged so as to follow the guide track.

There is also provided according to the teachings of the present invention, a vane oscillator system comprising: (a) a set of at least two of the aforementioned vane oscillators arranged in a rotationally symmetric configuration about a system axis, the virtual axis of each of the vane oscillators being parallel to the system axis, the mechanical transmission of each of the vane oscillators including a rocker arm fixed to the shaft and having an end extending from the shaft in a direction perpendicular to the length, the end featuring a cam follower; and (b) a flywheel rotatably mounted about the system axis, the flywheel providing a form-closed guide track encompassing but not symmetrical about the system axis, the cam follower of each of the vane oscillators being engaged so as to follow the guide track.

According to a further feature of the present invention, each of the vane oscillators is balanced such that the combined oscillating parts of each of the vane oscillators have substantially equal second moments of inertia.

According to a further feature of the present invention, the guide track is shaped such that rotation of the flywheel at a uniform angular velocity causes harmonic oscillation of the vane oscillators.

According to a further feature of the present invention, the guide track is annular.

According to a further feature of the present invention, the cavity is shaped such that a cross-section taken parallel to the axis is substantially rectangular, each of the first and second seals including a plurality of substantially L-shaped seal elements combined in overlapping relation to form a substantially rectangular seal.

According to a further feature of the present invention, each of the first and second seals further includes biasing means for biasing the plurality of seal elements outward against surfaces of the cavity.

According to a further feature of the present invention, the first and second seals further include channels formed through the vane and configured to provide fluid communication between the intermediate volume and at least one inner face of each of the seal elements.

According to a further feature of the present invention, each of the first and second seals further includes at least one supplementary sealing element located adjacent to a region of overlap between the seal elements and configured so as to impede flow of the liquid through the region of overlap.

According to a further feature of the present invention, each of the first and second ends of the cavity define a plane which is substantially parallel to, but displaced from, the axis, the vane further including shaped end pieces associated with both the first and the second seals, each of the shaped end pieces being configured to substantially fill one of the first and the second chambers when the vane assumes an extreme position.

According to a further feature of the present invention, the shaped end pieces exhibit a substantially triangular shape as viewed in a cross-section taken perpendicular to the axis.

There is also provided according to the teachings of the present invention, a vane oscillator system comprising: (a) a set of at least two vane oscillators each driven by a mechanical transmission including a shaft rotatable about an oscillator axis, the at least two vane oscillators being arranged in a rotationally symmetric configuration about a system axis with the oscillator axis of each of the vane oscillators parallel to the system axis, the mechanical transmission of each of the vane oscillators further including a rocker arm fixed to the shaft and having an end extending from the shaft in a direction perpendicular to the oscillator axis, the end featuring a cam follower; and (b) a flywheel rotatably mounted about the system axis, the flywheel providing a form-closed guide track encompassing but not symmetrical about the system axis, the cam follower of each of the vane oscillators being engaged so as to follow the guide track.

According to a further feature of the present invention, each of the vane oscillators, considered together with its corresponding mechanical transmission, is balanced such that the combined oscillating parts of each of the vane oscillators have substantially equal second moments of inertia.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
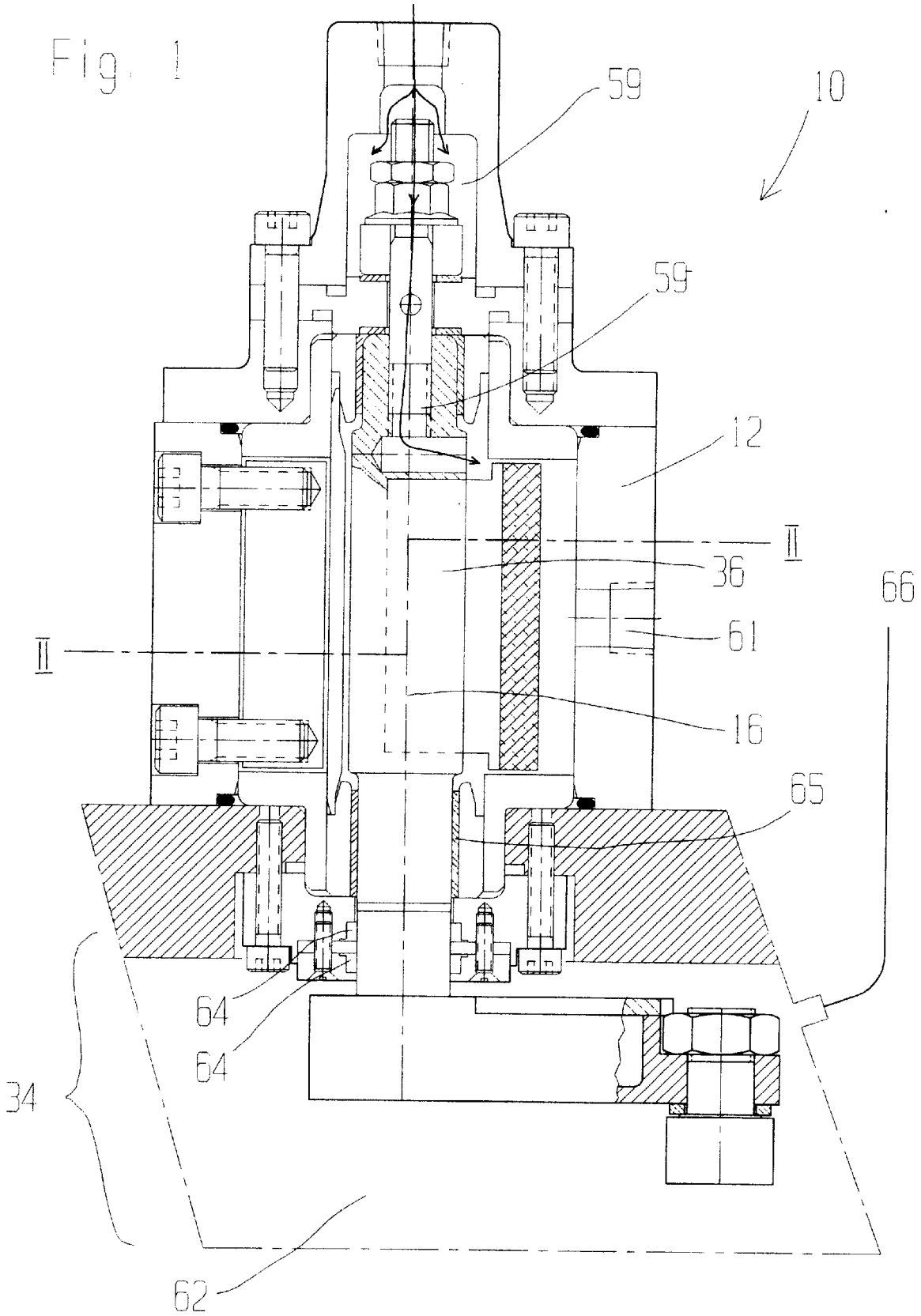
FIG. 1 is a vertical cross-section taken at a plane of symmetry passing through an axis of rotation of a liquid-sealed vane oscillator, constructed and operative according to the teachings of the present invention.

The present invention is a liquid-sealed vane oscillator and a system made up of a number of such oscillators.

The principles and operation of vane oscillators according to the present invention may be better understood with reference to the drawings and the accompanying description.

Referring now to the drawings, FIGS. 1–6 illustrate a liquid-sealed vane oscillator, generally designated 10, constructed and operative according to the teachings of the present invention.

Figure 3:
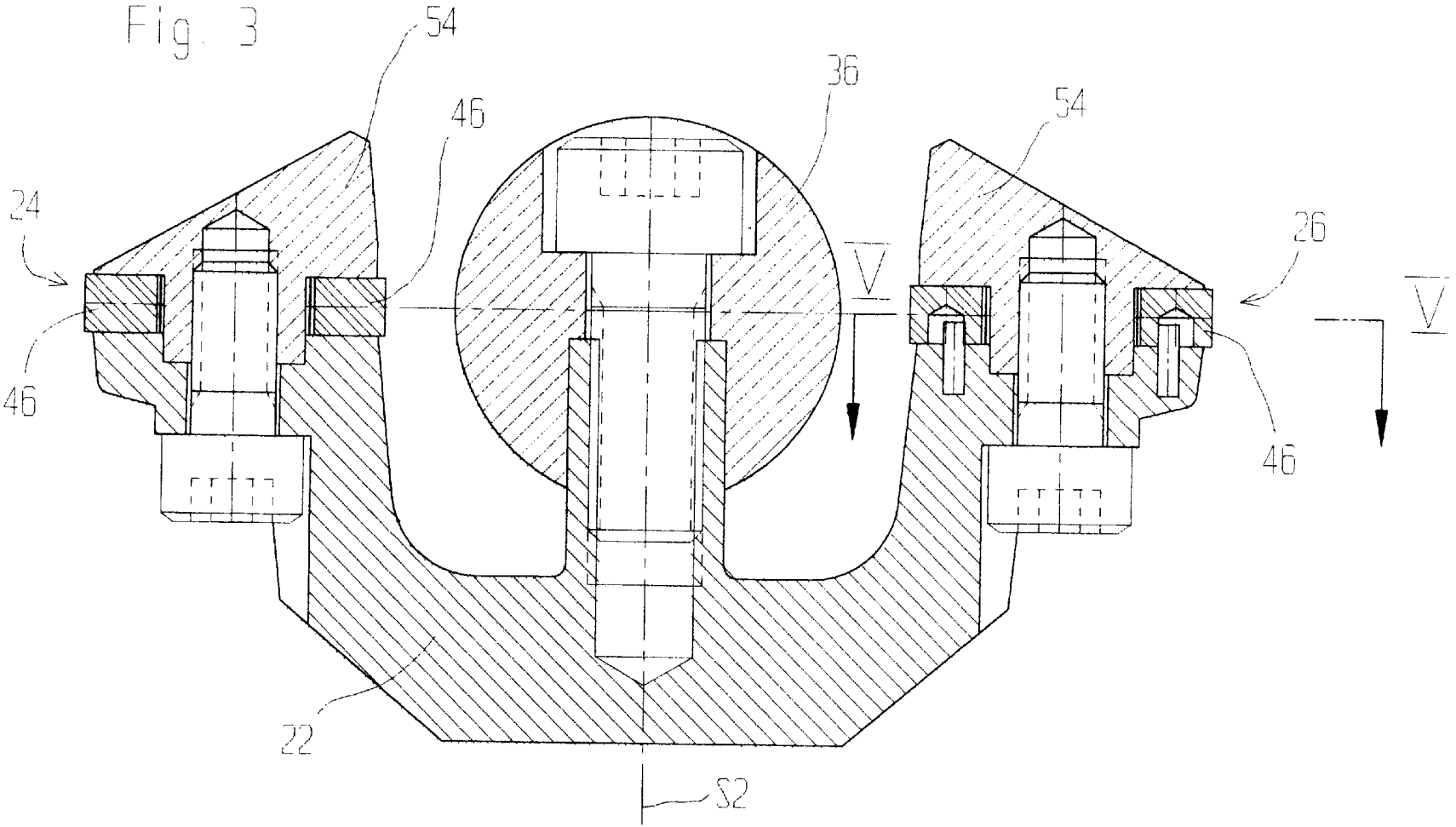
FIG. 3 is a detailed cross-sectional view of a vane element shown in FIG. 2.
Figure 4:
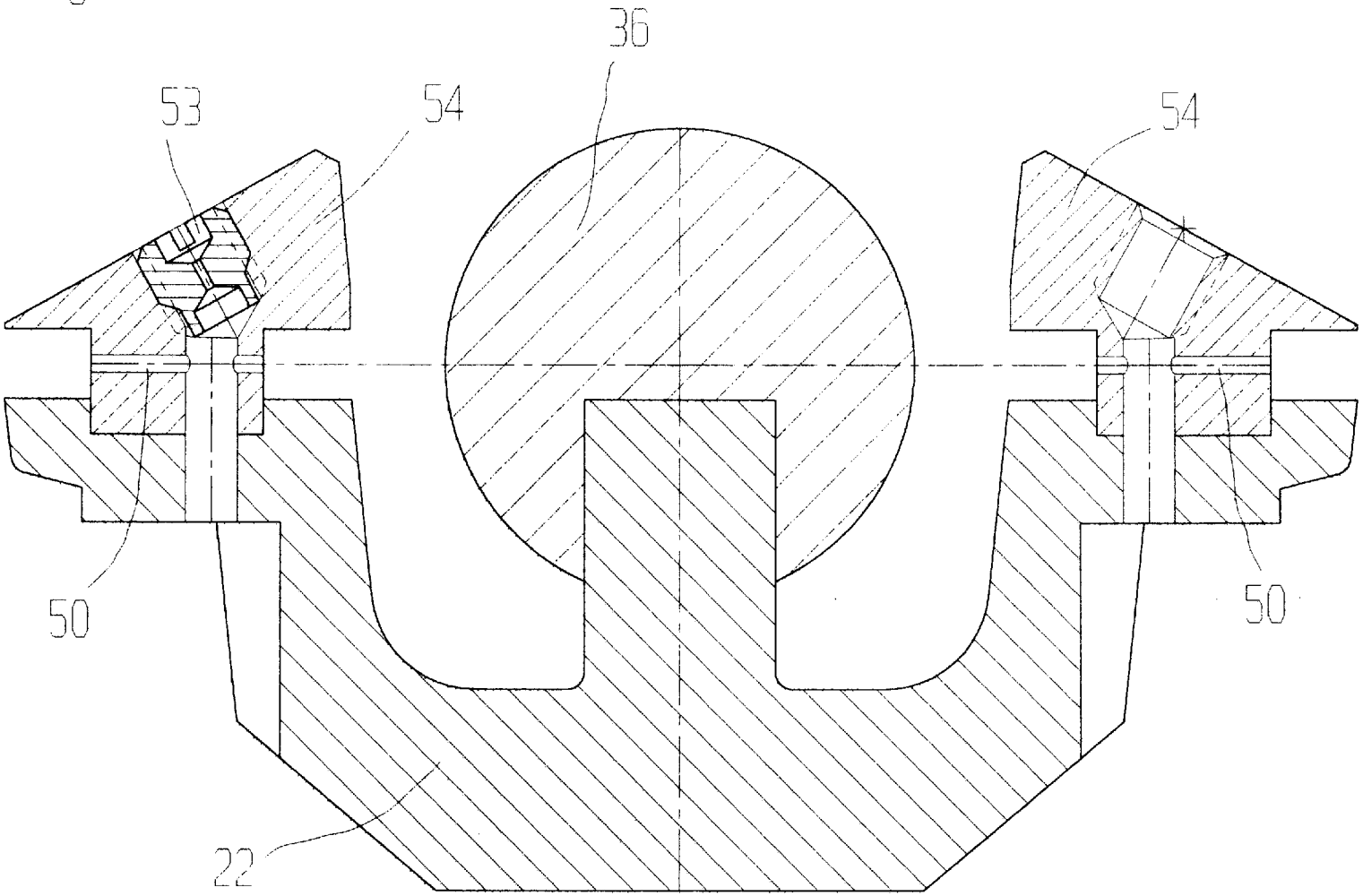
FIG. 4 is a second detailed cross-sectional view of the vane element from FIG. 2 taken at a different position along the axis of rotation.

Generally speaking, vane oscillator 10 features a housing 12 defining an oscillation cavity 14 formed to correspond to part of a virtual annulus centered around, and extending at least 180° about an axis 16. Cavity 14 is delimited by first and second ends 18 and 20. Mounted within cavity 14 so as to be rotatable about axis 16 is a vane 22, which typically has a plane of symmetry S2 as indicated in FIG. 3. Vane 22 includes a first and second seals 24 and 26, carried with vane 22 and deployed so as to subdivide cavity 14 into a first working chamber 28 of variable volume between first end 18 and first seal 24, a second working chamber 30 of variable volume between second end 20 and second seal 26, and an intermediate volume 32 between first seal 24 and second seal 26. Oscillatory rotation of vane 22 about axis 16 thus corresponds to oscillatory out-of-phase variations of volume of first and second working chambers 28 and 30. Intermediate volume 32 forms a fixed volume plenum which is carried with vane 22 as it oscillates.

The vane oscillator also includes a mechanical transmission 34 having an axial shaft 36 penetrating and extending from cavity 14. Axial shaft 36 is mechanically coupled to vane 22 so as to allow exchange of mechanical power with an external device.

Each chamber is in fluid communication with at least one, and typically two or more, ports 38. A liquid circulation system 40 (see FIG. 7), connected to both intermediate volume 32 and at least some of ports 38, is configured to supply a liquid to intermediate volume 32 at a pressure such that the liquid flows past first and second seals 24 and 26 into first and second chambers 28 and 30.

It will be apparent that, in contrast to the prior art device described above, the constant flow of liquid from intermediate volume 28 past seals 24 and 26 under pressure ensures the presence of a liquid seal, effectively sealing chambers 28 and 30. In a preferred embodiment, vane oscillator operates as a net flow device, each chamber having both a suction valve and a discharge valve. The liquid-gas mixture exits chambers 28, 30 during the exhaust phase of the pressure cycle via discharge valves, and is separated from the handled gas in a separator. In the case of compressor operation, the separated liquid may be reintroduced to intermediate volume 32 under its own high outlet pressure. In the case of an expander, the pressure of the separated liquid is raised to around the gas inlet pressure by a circulation pump before re-injection into intermediate volume 32.

The liquid sealed vane oscillator described here may be operated as either a compressor or an expander with work recovery. The sealing liquid which enters the pressure chambers mixes with the gas contained therein and absorbs the heat of compression. Since the heat capacity of the liquid is always overwhelmingly greater than that of the handled gas, the heat transferred to the liquid does not generally cause significant increase in temperature. If this temperature is such that the associated vapor pressure is less than the minimum operating pressure, most of the liquid remains in liquid form as droplets. As a result, if the gas is in intimate thermal contact with the liquid, the expansion/compression processes of the oscillator may be termed "near isothermal".

Figure 2:
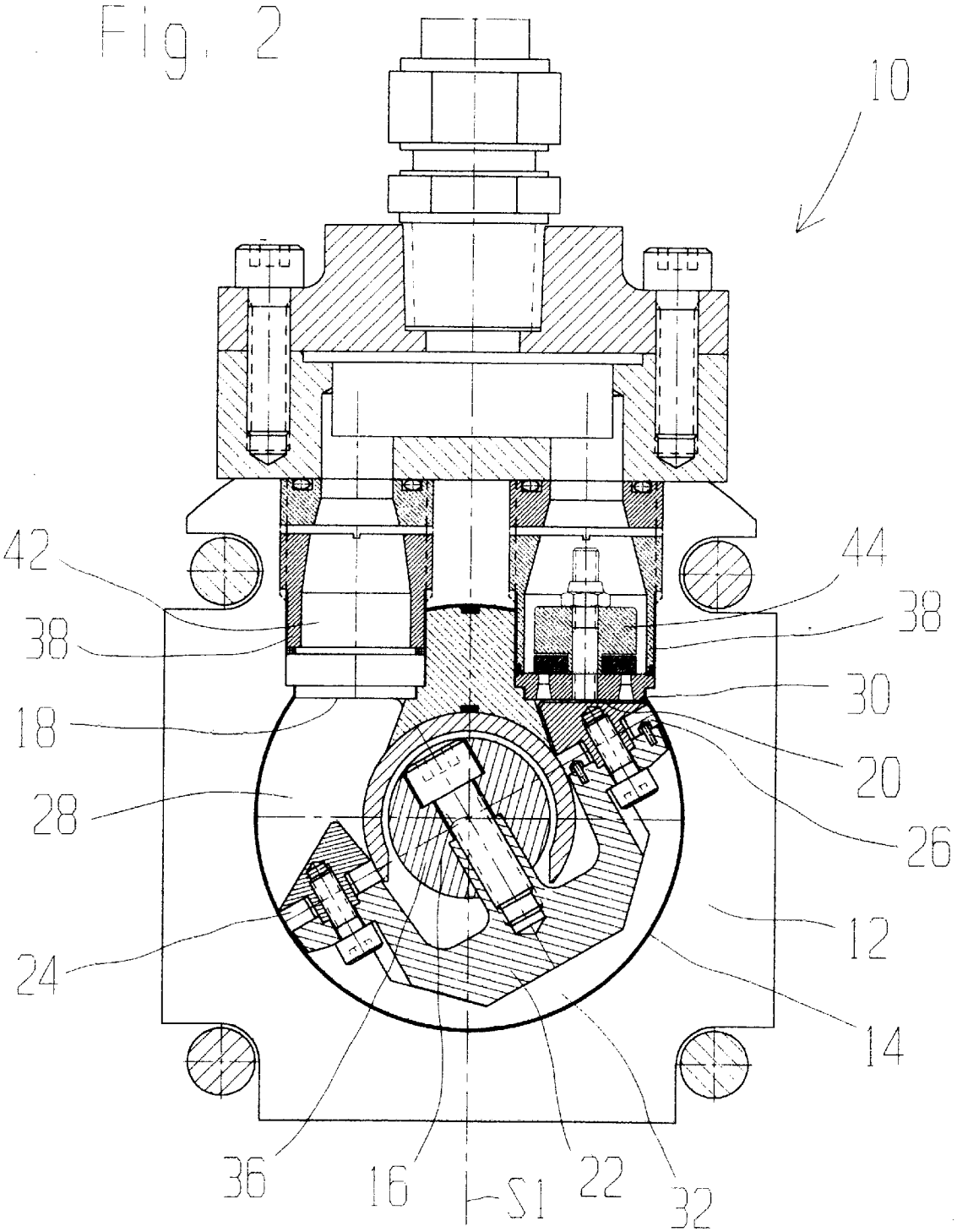
FIG. 2 is a cross-section taken along the line II—II through the vane oscillator of FIG. 1.

Turning now to the features of vane oscillator 10 in more detail, as already mentioned, each of first and second chambers 28 and 30 preferably features a number of ports 38 provided with at least one suction valve 42, visible on the left side of FIG. 2, and at least one discharge valve 44, visible on the right side of FIG. 2. In the case of elongated chambers, a plurality of each type of valve may be spaced along the chambers. The provision of suction and discharge valves renders the oscillator functional as a net flow device, either a mechanically driven compressor or a pressure driven expander. By way of example only, the present invention will be described principally in terms of a compressor. However, the slight modifications required to implement an expander according to the invention will be referred to briefly below, and are well within the abilities of one ordinarily skilled in the art.

It should be noted that cavity 14 is described as "corresponding to part of a virtual annulus" to the extent that it has a cross-sectional shape as taken through axis 16 which is substantially constant under rotation within a certain range of angles about axis 16. As a result, cavity 14 is typically symmetrical under reflection in a plane S1 indicated in FIG. 2. The aforementioned terminology is not, however, intended to limit the range of shapes which could be used for cavity 14 as viewed in a cross-section parallel to axis 16. Possible examples of cross-sectional shapes include, but are not limited to, rectangular, rounded, elongated. The preferred implementation illustrated here employs a generally rectangular cross-section, elongated parallel to axis 16.

Furthermore, it should be appreciated that near-uniformity of cross-sectional shape around cavity 14 is primarily important only for the parts of cavity 14 swept by first and second seals 24 and 26. If the position of the seals and the angular extent of the cavity are such that a central portion of the cavity is not swept by either of first and second seals 24 and 26 during oscillation of vane 22, this central portion may vary from an annular shape. Such variations are also included within the "substantially annular" terminology of the present invention. Parenthetically, the freedom to vary the cavity shape within this central portion makes this portion the preferred region for locating the sealing liquid inlets. It should be noted however that a generally uniform annular central portion is typically preferred, providing minimum viscous losses, least build-up of material and optimal spreading of stresses caused by pressure within the cavity.

Figure 5:
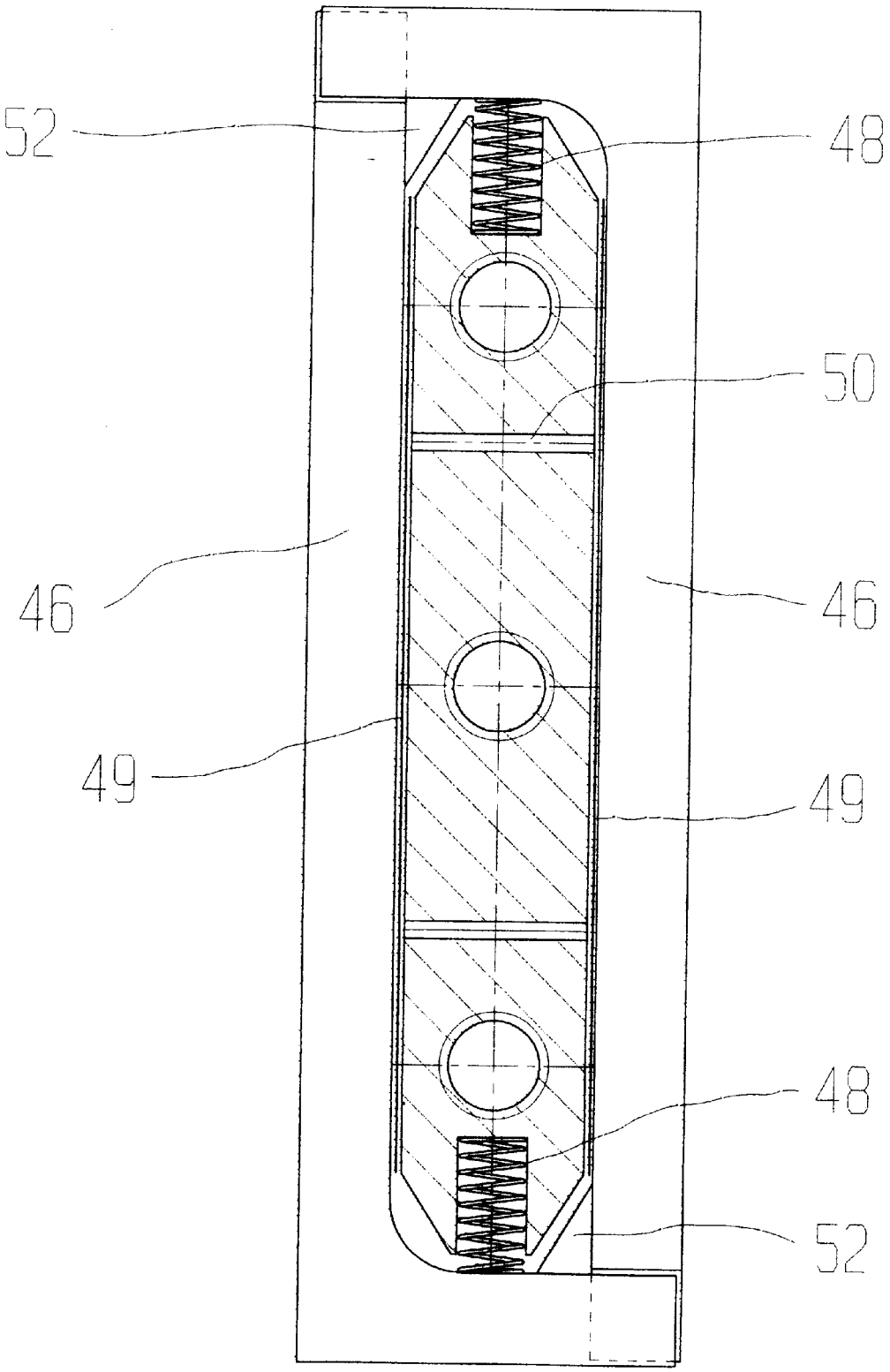
FIG. 5 is a cross-section of a seal from the vane element of FIG. 3 taken along line V—V.

In the case of the preferred rectangular cross-section cavity 22 mentioned above, first and second seals 24 and 26 preferably include a number of substantially L-shaped seal elements 46 (see FIGS. 6A–6C, 10A and 10B) combined in overlapping relation to form a substantially rectangular extensible seal (FIG. 5). Seal elements 46 are biased outward against surfaces of cavity 14 by light spring loading, typically provided by compression springs 48 at the ends and leaf springs 49 along the long sides of the rectangular seal. Channels 50 (FIG. 4) are formed through vane 22 and configured to provide fluid communication between intermediate volume 32 and an inner face of each of seal elements 46, serving to equalize liquid pressure between the inner and outer faces of the seal elements. This enables the use of light spring biasing, thereby minimizing friction. Excess seepage of liquid through regions of overlap between seal elements 46 is impeded by providing supplementary sealing elements 52, in this case triangular blocks, located adjacent to the regions of overlap.

Figure 6A:
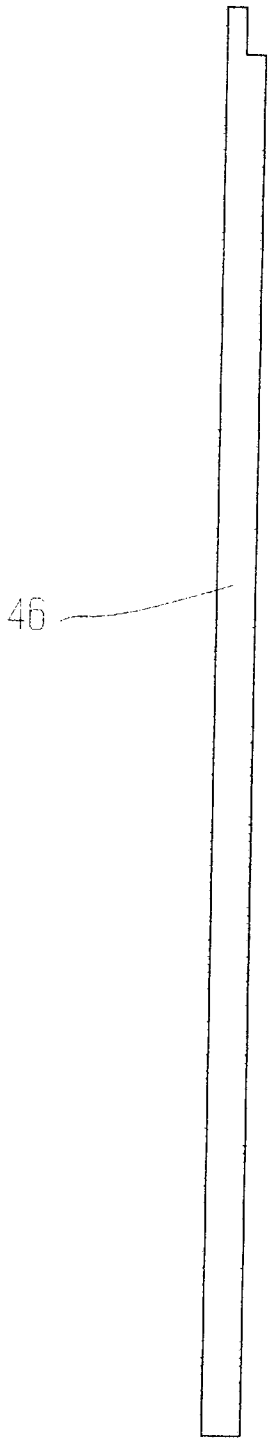
FIGS. 6A, 6B, 6C are side, top and end views, respectively, of a full-width L-shaped seal element from the seal of FIG. 5.
Figure 6B:
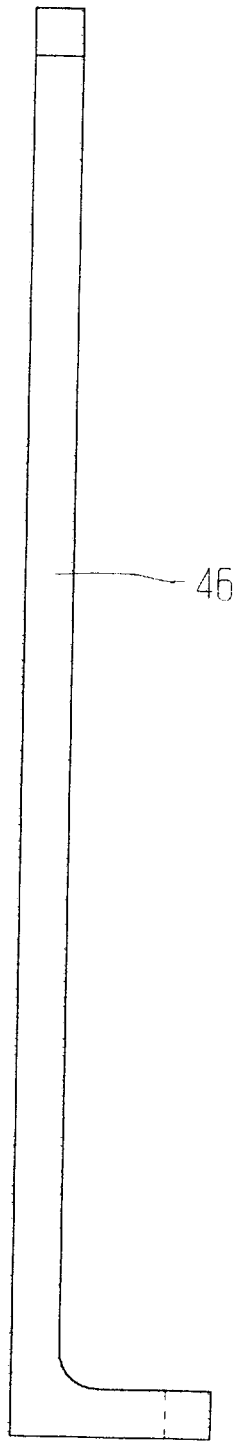
Figure 6C:
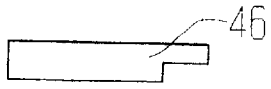
Figure 10A:
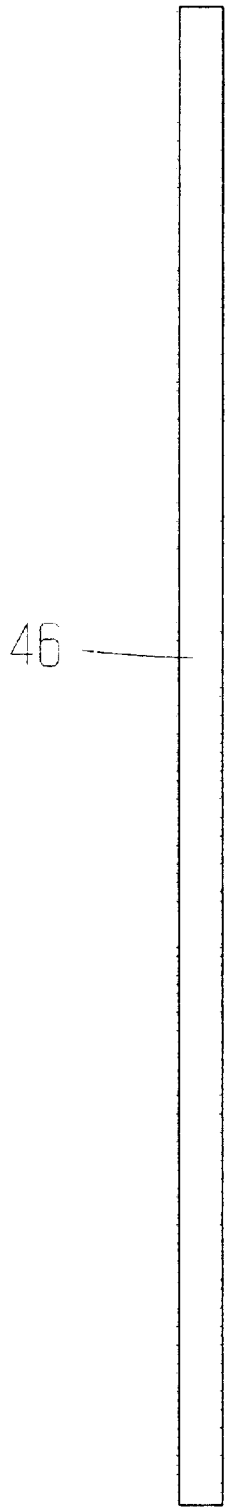
FIGS. 10A and 10B are side and top views, respectively, of an alternative fractional-width L-shaped seal element from the seal of FIG. 5.
Figure 10B:
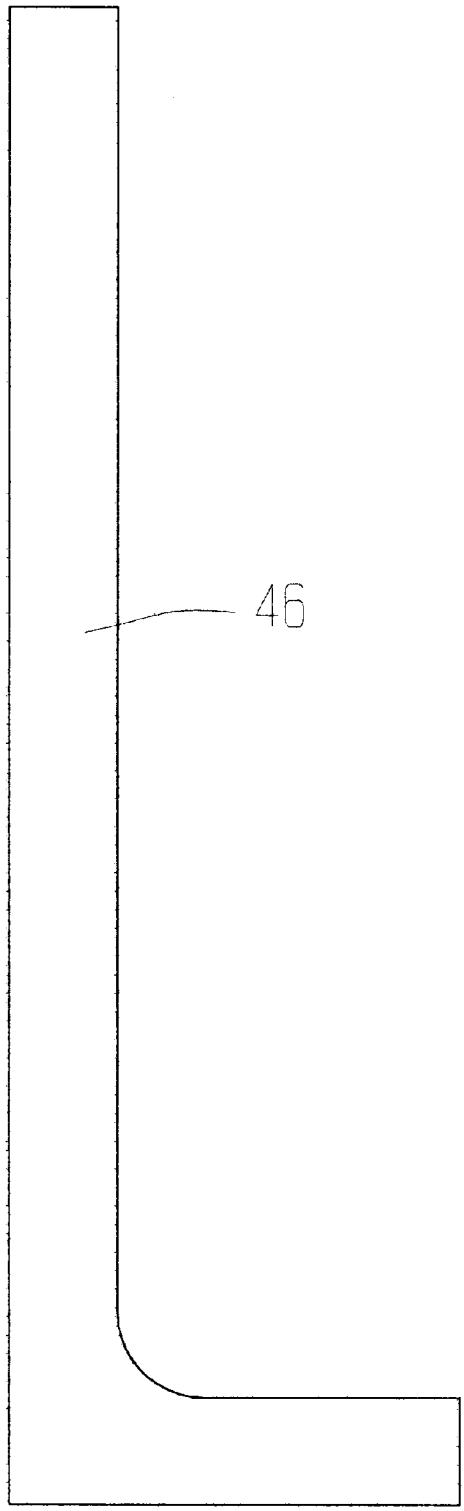

It will be noted that the ends of seal elements 46 as shown in FIGS. 6A–6C are stepped to generate layered overlapping joints. FIGS. 10A and 10B show an alternative implementation in which seal elements 46 are uniform thickness L-shaped elements with one dimension reduced relative to the equivalent dimension in FIGS. 6A–6C. In this case, at least two pairs of abutting seal elements 46 are preferably used in reversed relation so as to ensure overlapping of the abutment region of one pair by the seal element of the next layer.

As already noted, the present invention generates a flow of sealing liquid past seals 24 and 26 into first and second chambers 28 and 30. Where near isothermal operation is not required, and even in many cases where it is required, the resultant quantities of liquid present within chambers 28 and 30 are sufficient without any supplementation. Optionally, for implementations where larger heat absorption/exchange is required, liquid injection nozzles 53 (see FIG. 4) are deployed on vane 22 so as to inject a controlled spray of the working liquid into chambers 28 and 30.

Referring now back to FIG. 2, it will be noted that the ends of cavity 14 are not radially orientated relative to axis 16. Instead, for convenience and precision of implementation, they define a common plane which is perpendicular to the plane of symmetry S1 of cavity 14, but displaced from axis 16. In this case, vane 22 preferably further includes shaped end pieces 54 associated with both first and second seals 24 and 26, and configured to substantially fill chambers 28 and 30 when vane 22 assumes its extreme positions. Shaped end pieces 54 greatly reduce the dead volume at the end of each stroke, thereby improving the volumetric efficiency of the oscillator. In the example shown, shaped end pieces 54 exhibit a substantially triangular shape as viewed in a cross-section taken perpendicular to axis 16.

Figure 7:
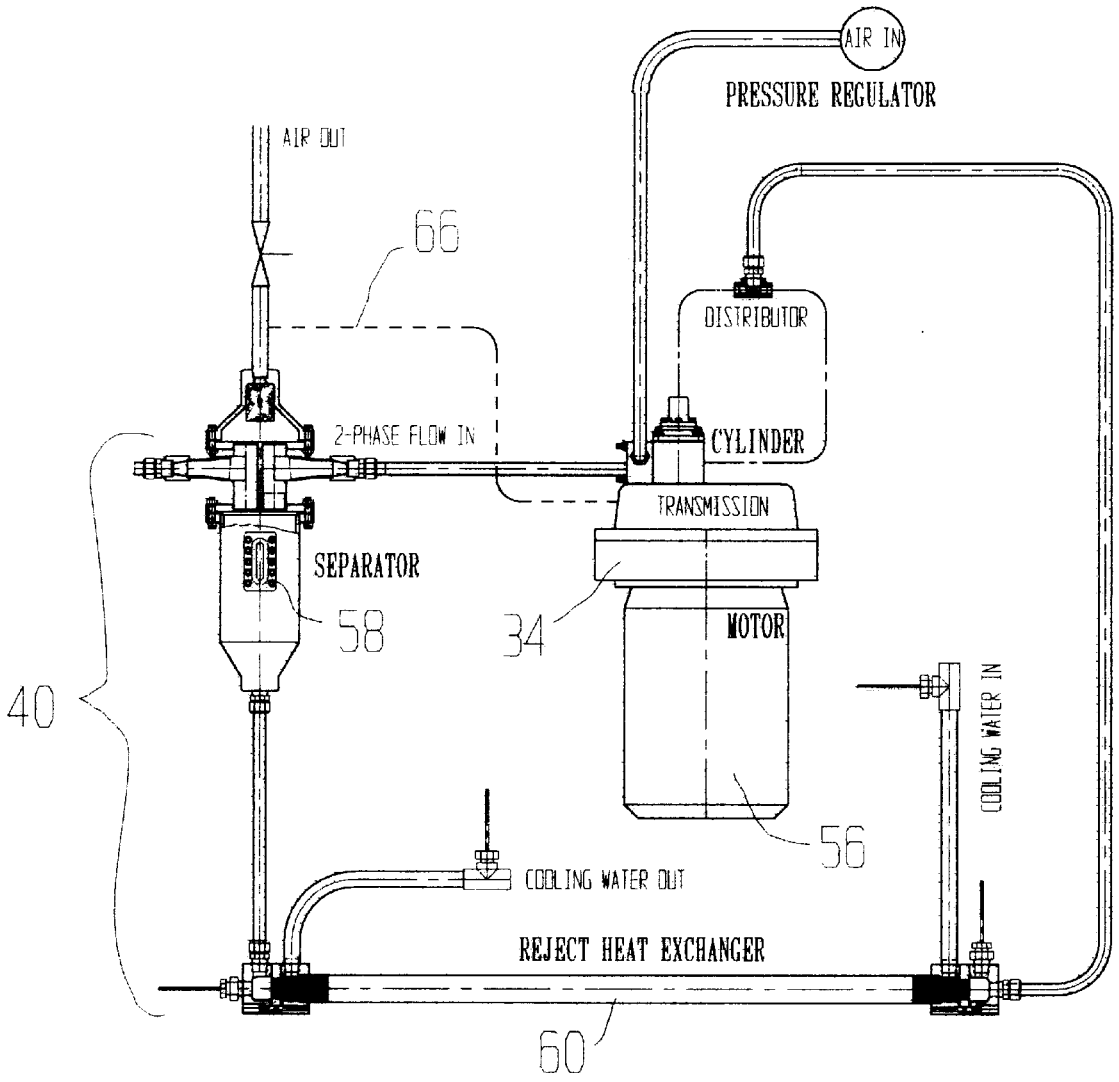
FIG. 7 is a schematic flow diagram for a booster compressor employing the vane oscillator of FIG. 1.

FIG. 7 shows the remaining features of vane oscillator 10 for a typical compressor implementation in which mechanical transmission 34 is driven by an external power source, here a motor 56. Liquid circulation system 40 includes a separator 58 associated with discharge valves 44 of chambers 28 and 30 so as to collect amounts of the liquid from a gas-liquid mixture discharged from the chambers. Separator 58 is connected so as to supply the collected liquid to intermediate volume 32 at a pressure substantially equal to the discharge pressure of the chambers. Since, in a compressor, the discharge pressure always exceeds the average pressure of the working chambers, the discharge pressure itself is sufficient to produce forced recirculation of the sealing liquid.

Where near-isothermal operation is required, liquid circulation system 40 further includes a heat exchanger 60 connected serially between the liquid outlet of separator 58 and intermediate volume 32 for removing heat of compression. Heat exchanger 60 may be of any conventional type capable of carrying the high pressure of the compressor. It should be understood that the phrase "connected serially" as used in this context is not intended to imply direct connection, and thus does not preclude the possibility of additional elements being interposed between the connected elements.

It should be noted that the two working chambers of oscillator 10 may optionally be used as parts of two isolated circulation systems, such as for pumping two different gases simultaneously. In such a case, each discharge valve is connected to a dedicated separator of which the gas outlet is attached to the appropriate gas flow line. The liquid outputs from the two separators may be recombined, or may be fed separately back to intermediate volume 32.

Connection of liquid circulation system 40 to intermediate volume 32 may be achieved in a number of ways. In a preferred implementation, the liquid is introduced through channels 59 which pass along or around axial shaft 36 as shown in FIG. 1, then being released outwards into intermediate volume 32. Alternatively, or additionally, liquid may be introduced from the outside of cavity 14, such as through an aperture 61, preferably located within a central region not swept by first and second seals 24 and 26.

Turning now to features of mechanical transmission 34, it is a preferred feature of the present invention that at least a part of mechanical transmission 34 adjacent to penetration of shaft 36 into cavity 14 is located within a casing 62 having an enclosed casing volume which is maintained at elevated pressure (see FIG. 1). This reduces the pressure differential across the penetration seal to a level at which a low-cost liquid seal ring is sufficient to provide an effective seal. Seal glands 64 are illustrated in FIG. 1 for this purpose. For such a structure to provide an effective seal, the pressure within casing 62 must be maintained at a level differing from a pressure within intermediate volume 32 by no more than about two atmospheres.

In the compressor implementation described here, the desired pressure is preferably achieved by a pressure equalization line 66 which provides fluid connection between the gas outlet of separator 58 and casing 62 so as to maintain the casing volume at elevated pressure. Preferably, the pressure is approximately equal to the maximum operating pressure of the first chamber (see FIG. 7) which is, in turn, approximately equal to the pressure within intermediate volume 32 to which the sealing rings within seal glands 64 are exposed via liquid lubricated lower bearing 65.

Figure 8:
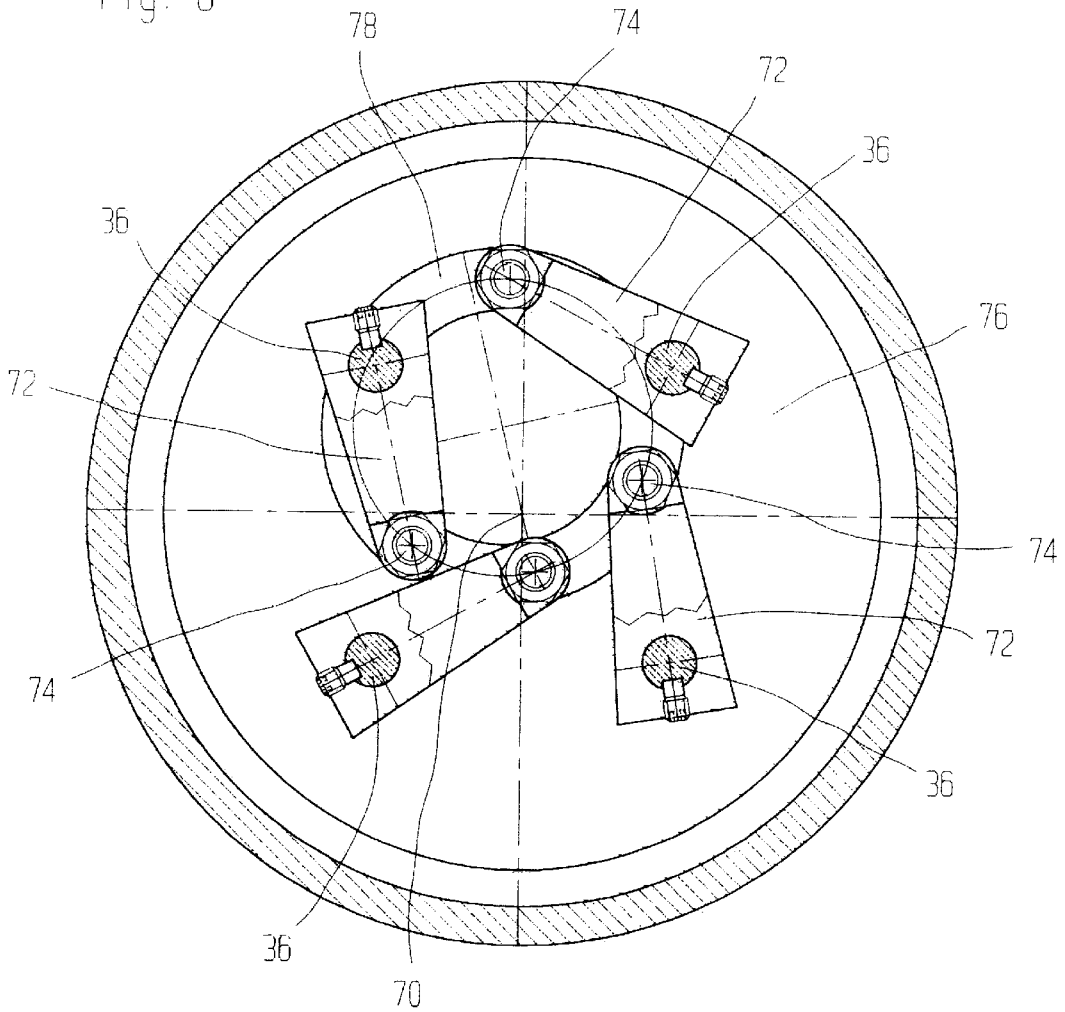
FIG. 8 is a horizontal cross-section through a transmission housing of a balanced synchronous system employing four vane oscillators similar to that of FIG. 1.
Figure 9A:
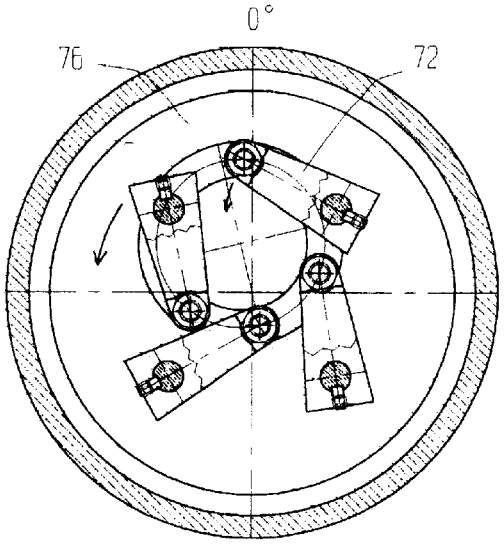
FIGS. 9A–9D show four successive stages of operation of the transmission of FIG. 8.
Figure 9B:
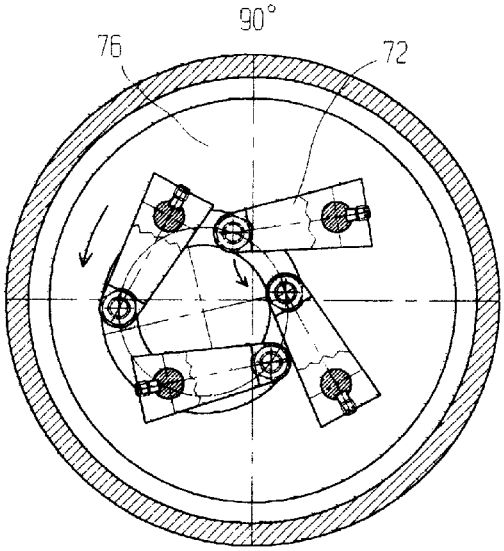
Figure 9C:
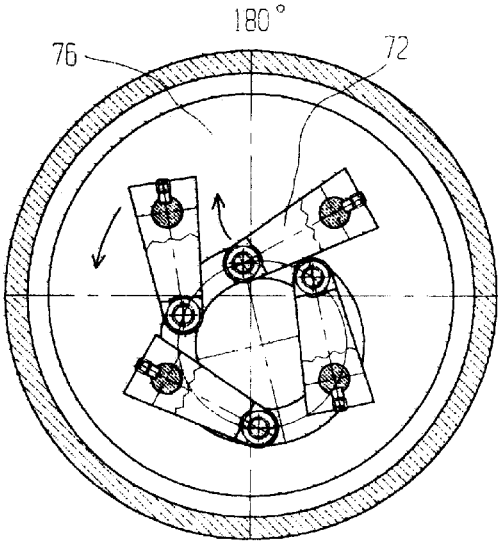
Figure 9D:
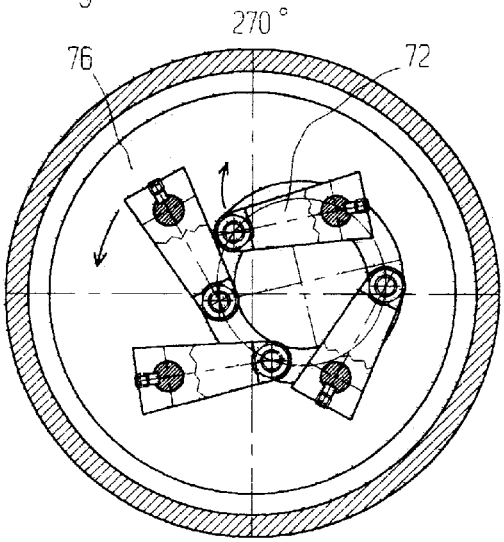

Turning now to FIGS. 8 and 9, one specific implementation of mechanical transmission 34 for a vane oscillator system will be described. This implementation is of particular value in a multiple oscillator system in which two or more oscillators are arranged with their shafts 36 deployed parallel in a rotationally symmetric formation around a system axis 70.

In this implementation, each axial shaft 36 supports a transversely extending rocker arm 72 which terminates in an end featuring a cam follower 74. Beneath rocker arms 72 is a flywheel 76 which is driven to rotate about system axis 70. Flywheel 76 has a form-closed guide track 78, encompassing but not symmetrical about system axis 70, with which cam followers 74 are engaged.

FIGS. 9A–9D trace the progression of motion of rocker arms 72 as flywheel 76 turns. It will be apparent that the different rocker arms, and hence the different oscillators, oscillate out of phase with a phase lag corresponding to their angular positions around system axis 70. This greatly reduces system vibration and produces an approximately even load on the power supply.

One approach to further optimization of the mechanical transmission is to design guide track 78 to generate true harmonic oscillations. With such a guide track, so long as all of the vane oscillators have equal second moments of inertia, the total inertial moments acting on the entire structure cancel out to zero, thereby eliminating vibration. It is, however, difficult to produce such a guide track using commonly available technologies to fit the cam-followers 74 with very high precision. As a result, this implementation may suffer from cross-over shocks generated as the cam followers cross between the inner and outer edges of guide track 78.

To counter the problem of cross-over shocks, an annular guide track 78 is typically preferred. Such a track can be produced with relative ease to fit cam followers 74 with sufficient precision to minimize or effectively eliminate destructive cross-over shocks. Even though the motion generated by such a track is not simple harmonic, a rotationally symmetric layout of vane oscillators having equal second moments of inertia is still highly effective to reduce the net overall inertial moment so as to minimize vibration of the system.

Turning briefly to the expander implementations of the present invention, a number of minor adaptations follow directly from the change in functionality. Firstly, since the inlet pressure of an expander is higher than the outlet pressure, a pump (not shown) must be connected serially between the liquid outlet of separator 58 and intermediate volume 32 for injecting the collected liquid back into intermediate volume 32. Where a heat exchanger is provided for the expander, it serves to supply the heat of expansion.

Pressurization of the mechanical transmission casing may be achieved by connection to any source of pressurized fluid, including but not limited to the inlet gas supply.

Optionally, at least part of liquid circulation system 40 may be "open" with liquid pumped from an outside source into intermediate volume 32 and with the liquid outlet of the separator drained to an independent sink for liquid storage or further drainage. Thus, it should be appreciated that liquid circulation system 40 is so named for its function of causing a flow of liquid through the vane oscillator and does not necessarily re-circulate a constant body of fluid.

In all other respects, implementation of the invention as an expander will be fully understood by one familiar with the art from the details of the compressor implementation described above.

It will be appreciated that the above descriptions are intended only to serve as examples, and that many other embodiments are possible within the spirit and the scope of the present invention.

What is claimed is:

1. A liquid-sealed vane oscillator comprising:

(a) a housing having a virtual axis, said housing defining a cavity formed to correspond to part of a virtual annulus centered around, and extending at least 180° about, said axis, said cavity being delimited by a first end and a second end;

(b) a vane mounted within said cavity so as to be rotatable about said axis, said vane including a first seal and a second seal carried with said vane and deployed so as to subdivide said cavity into a first chamber of variable volume between said first end and said first seal, a second chamber of variable volume between said second end and said second seal, and an intermediate volume between said first seal and said second seal, such that oscillatory rotation of said vane about said axis corresponds to oscillatory out-of-phase variations of volume of said first and second chambers;

(c) at least one port in fluid communication with each of said first and second chambers;

(d) a mechanical transmission including an axial shaft penetrating and extending from said cavity, said axial shaft being mechanically coupled to said vane so as to allow exchange of mechanical power with an external device; and (e) a liquid circulation system in fluid communication with both said intermediate volume and said at least one port of each of said first and second chambers, said liquid circulation system being configured to supply a liquid to said intermediate volume at a pressure such that said liquid flows past said first and second seals into said first and second chambers.

2. The vane oscillator of claim 1, wherein said at least one port in fluid communication with each of said first and second chambers features a suction valve and a discharge valve for each of said first and second chambers.

3. The vane oscillator of claim 2, wherein said liquid circulation system includes:

(a) a separator associated with said discharge valve of at least said first chamber so as to collect amounts of said liquid from a gas-liquid mixture discharged from said first chamber; and (b) a pump connected serially between a liquid outlet of said separator and said intermediate volume for injecting said collected liquid into said intermediate volume.

4. The vane oscillator of claim 3, wherein said liquid circulation system further includes a heat exchanger connected in series with said pump between said liquid outlet of said separator and said intermediate volume for supplying heat of expansion.

5. The vane oscillator of claim 2, wherein said mechanical transmission is driven by an external power source such that the vane oscillator functions as a compressor, said liquid circulation system including a separator associated with said discharge valve of at least said first chamber so as to collect amounts of said liquid from a gas-liquid mixture discharged from said first chamber, said separator being connected so as to supply said collected liquid to said intermediate volume at a pressure substantially equal to a discharge pressure of said first chamber.

6. The vane oscillator of claim 5, wherein said liquid circulation system further includes a heat exchanger connected serially between a liquid outlet of said separator and said intermediate volume for removing heat of compression.

7. The vane oscillator of claim 5, wherein at least a part of said mechanical transmission adjacent to penetration of said shaft into said cavity is located within a casing having an enclosed casing volume, the vane oscillator further comprising a pressure equalization line providing fluid connection between a gas outlet of said separator so as to maintain said casing volume at a pressure substantially equal to a maximum operating pressure of said first chamber.

8. The vane oscillator of claim 2, wherein at least a part of said mechanical transmission is located within a casing having an enclosed casing volume, the vane oscillator further comprising a source of pressurized fluid connected to said casing volume so as to maintain said casing volume at an elevated pressure.

9. The vane oscillator of claim 2, wherein said mechanical transmission further includes:

(a) a rocker arm fixed to said shaft and having an end extending from said shaft in a direction perpendicular to said virtual axis, said end featuring a cam follower;

(b) a flywheel rotatably mounted about a flywheel axis parallel to, but displaced from, said virtual axis, said flywheel providing a form-closed guide track encompassing but not symmetrical about said flywheel axis, said cam follower being engaged so as to follow said guide track.

10. A vane oscillator system comprising:

(a) a set of at least two vane oscillators as in claim 2 arranged in a rotationally symmetric configuration about a system axis, said virtual axis of each of said vane oscillators being parallel to said system axis, said mechanical transmission of each of said vane oscillators including a rocker arm fixed to said shaft and having an end extending from said shaft in a direction perpendicular to said length, said end featuring a cam follower; and (b) a flywheel rotatably mounted about said system axis, said flywheel providing a form-closed guide track encompassing but not symmetrical about said system axis, said cam follower of each of said vane oscillators being engaged so as to follow said guide track.

11. The vane oscillator system of claim 10, wherein each of said vane oscillators is balanced such that the combined oscillating parts of each of said vane oscillators have substantially equal second moments of inertia.

12. The vane oscillator system of claim 11, wherein said guide track is shaped such that rotation of said flywheel at a uniform angular velocity causes harmonic oscillation of said vane oscillators.

13. The vane oscillator system of claim 11, wherein said guide track is annular.

14. The vane oscillator of claim 1, wherein said cavity is shaped such that a cross-section taken parallel to said axis is substantially rectangular, each of said first and second seals including a plurality of substantially L-shaped seal elements combined in overlapping relation to form a substantially rectangular seal.

15. The vane oscillator of claim 14, wherein each of said first and second seals further includes biasing means for biasing said plurality of seal elements outward against surfaces of said cavity.

16. The vane oscillator of claim 15, wherein said first and second seals further include channels formed through said vane and configured to provide fluid communication between said intermediate volume and at least one inner face of each of said seal elements.

17. The vane oscillator of claim 16, wherein each of said first and second seals further includes at least one supplementary sealing element located adjacent to a region of overlap between said seal elements and configured so as to impede flow of said liquid through said region of overlap.

18. The vane oscillator of claim 1, wherein each of said first and second ends of said cavity define a plane which is substantially parallel to, but displaced from, said axis, said vane further including shaped end pieces associated with both said first and said second seals, each of said shaped end pieces being configured to substantially fill one of said first and said second chambers when said vane assumes an extreme position.

19. The vane oscillator of claim 18, wherein said shaped end pieces exhibit a substantially triangular shape as viewed in a cross-section taken perpendicular to said axis.

20. A vane oscillator system comprising:

(a) a set of at least two vane oscillators each driven by a mechanical transmission including a shaft rotatable about an oscillator axis, said at least two vane oscillators being arranged in a rotationally symmetric configuration about a system axis with said oscillator axis of each of said vane oscillators parallel to said system axis, said mechanical transmission of each of said vane oscillators further including a rocker arm fixed to said shaft and having an end extending from said shaft in a direction perpendicular to said oscillator axis, said end featuring a cam follower; and (b) a flywheel rotatably mounted about said system axis, said flywheel providing a form-closed guide track encompassing but not symmetrical about said system axis, said cam follower of each of said vane oscillators being engaged so as to follow said guide track.

21. The vane oscillator system of claim 20, wherein each of said vane oscillators, considered together with its corresponding mechanical transmission, is balanced such that the combined oscillating parts of each of said vane oscillators have substantially equal second moments of inertia.

* * * * *